US009617994B2

(12) United States Patent
Walters et al.

(10) Patent No.: US 9,617,994 B2
(45) Date of Patent: Apr. 11, 2017

(54) PUMP WITH MECHANICAL SEAL ASSEMBLY

(71) Applicant: DELAWARE CAPITAL FORMATION, INC., Wilmington, DE (US)

(72) Inventors: Michael Douglas Walters, Hudsonville, MI (US); Michael Thomas Mitchell, Delton, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 242 days.

(21) Appl. No.: 14/689,240

(22) Filed: Apr. 17, 2015

(65) Prior Publication Data

US 2015/0300352 A1 Oct. 22, 2015

Related U.S. Application Data

(60) Provisional application No. 61/981,341, filed on Apr. 18, 2014.

(51) Int. Cl.
*F01D 3/00* (2006.01)
*F01D 17/00* (2006.01)
(Continued)

(52) U.S. Cl.
CPC ..... *F04C 15/0007* (2013.01); *F01C 21/108* (2013.01); *F04C 2/3442* (2013.01);
(Continued)

(58) Field of Classification Search
CPC F01C 21/108; F04C 15/0007; F04C 15/0023; F04C 15/0038; F04C 15/0061;
(Continued)

(56) References Cited

U.S. PATENT DOCUMENTS 2,679,412 A 3/1950 Whitfield
2,902,943 A 9/1959 Fuerst et al.
(Continued)

FOREIGN PATENT DOCUMENTS

DE 102011116858 A1 4/2013
WO WO 2010-017795 A2 2/2010

OTHER PUBLICATIONS

The International Search Report and Written Opinion of the International Searching Authority for PCT/US2015/026308, date completed Jul. 31, 2015, date mailed Aug. 10, 2015.

*Primary Examiner* — Mark A Laurenzi
*Assistant Examiner* — Anthony Ayala Delgado
(74) *Attorney, Agent, or Firm* — Miller Canfield Paddock and Stone; Mark L Maki

(57) ABSTRACT

A sliding vane, positive displacement pump is provided which includes a dual mechanical seal that protects against leakage from a pump chamber while also reducing slip across rotor end faces. The dual mechanical seal may be formed as a cartridge seal that is readily demountable from the pump for replacement and service, and is retrofittable to existing pumps to improve the performance thereof. The pump may integrally include a dual mechanical seal, or the mechanical seal assembly may be provided for use by itself or in combination with a replaceable head ring that can be installed on existing pumps for repair thereof or for a retrofit upgrade of such existing pump.

25 Claims, 10 Drawing Sheets

(51) Int. Cl.

| | |
|---|---|
| ***F16J 15/40*** | (2006.01) |
| ***F04C 15/00*** | (2006.01) |
| ***F04C 2/344*** | (2006.01) |
| ***F04C 18/344*** | (2006.01) |
| ***F04C 27/00*** | (2006.01) |
| ***F04C 29/00*** | (2006.01) |
| ***F01C 21/10*** | (2006.01) |

(52) U.S. Cl.
CPC ..... *F04C 2/3448* (2013.01); *F04C 15/0023* (2013.01); *F04C 15/0061* (2013.01); *F04C 18/3448* (2013.01); *F04C 27/001* (2013.01); *F04C 29/005* (2013.01); *F04C 15/0038* (2013.01)

(58) Field of Classification Search
CPC .. F04C 18/3448; F04C 27/001; F04C 29/005; F04C 2/3442; F04C 2/3448
USPC ..... 418/104, 145–148, 259–269; 277/361
See application file for complete search history.

(56) References Cited

U.S. PATENT DOCUMENTS

| | | | | | |
|---|---|---|---|---|---|
| 3,246,574 | A | | 4/1966 | Eickmann | |
| 3,582,090 | A | * | 6/1971 | Lott | F04B 9/117 137/864 |
| 3,591,188 | A | | 7/1971 | Eisner | |
| 4,012,049 | A | * | 3/1977 | Lambrecht | F16J 15/441 277/321 |
| 4,101,139 | A | | 7/1978 | Nordin | |
| 4,268,232 | A | | 5/1981 | Haupt | |
| 4,625,977 | A | * | 12/1986 | Azibert | F16J 15/008 277/361 |
| 4,900,039 | A | | 2/1990 | Klecker et al. | |
| 4,993,917 | A | * | 2/1991 | Kulle | F01D 3/04 277/361 |
| 5,116,208 | A | | 5/1992 | Parme | |
| 5,261,676 | A | | 11/1993 | Rockwood | |
| 5,411,366 | A | | 5/1995 | Rockwood | |
| 5,421,593 | A | * | 6/1995 | Aritsubo | F16J 15/3484 277/361 |
| 5,499,902 | A | | 3/1996 | Rockwood | |
| 5,820,129 | A | | 10/1998 | Reagan | |
| 6,095,780 | A | | 8/2000 | Ernens | |
| 6,524,059 | B1 | * | 2/2003 | Nogiwa | F01D 11/04 415/112 |
| 7,097,176 | B2 | | 8/2006 | Azibert | |
| 7,370,864 | B2 | | 5/2008 | Azibert | |
| 2013/0259679 | A1 | * | 10/2013 | Brailean | F16J 15/008 415/230 |
| 2013/0309114 | A1 | | 11/2013 | Walters | |

* cited by examiner

PUMP WITH MECHANICAL SEAL ASSEMBLY

CROSS REFERENCE TO RELATED APPLICATIONS

This application asserts priority from provisional application 61/981,341, filed on Apr. 18, 2014, which is incorporated herein by reference.

FIELD OF THE INVENTION

The invention relates to a pump such as a sliding vane positive displacement pump, and more particularly, to a pump provided with a cartridge seal in a dual mechanical seal configuration.

BACKGROUND OF THE INVENTION

In sliding vane positive displacement pumps, such pumps are used in a number of different industrial and commercial processes to force fluid movement from a first location to a second location. Generally, such a pump includes a hollow housing or casing shaped to define a pump chamber. Typically, the pump chamber has an eccentric, non-circular cross-sectional profile, preferably defined by a liner that is stationarily supported in the casing. The pump chamber is supplied with process fluid through an inlet and discharges the process fluid from an outlet at an increased discharge pressure.

In prior art pumps of this type, the opposite ends of the pump chamber are open but closed off by disc-like, first and second head plates bolted to the opposite sides of the casing. The first and second head plates sandwich the liner therebetween so as to prevent movement during shaft rotation. The shaft extends through the casing and is driven by a motor or other motive means wherein the shaft drives a rotor located within the pump chamber.

To effect pumping, the rotor may include vane slots, which are spaced circumferentially from each other and open radially outwardly. The vane slots also open axially through the opposite rotor faces toward the opposing faces of the head plates. Vanes project outwardly from the slots and are movable radially into and out of the slots so as to closely follow the inner profile of the liner. As the shaft and rotor turn, the volume of the space in the chamber between circumferentially adjacent vanes and the radially opposed surfaces of the rotor and liner (each space referred to as a fluid cavity), cyclically increases and decreases due to the eccentric profile defined by the liner.

In more detail, the shaft extends through shaft holes which are formed in the center of the head plates. A small radial gap is defined between the inside diameter of the shaft holes and the opposing outside diameter of the shaft surface, and while some process fluid might leak axially out of the pump chamber along the radial gaps, mechanical seals are provided on the opposite shaft ends to prevent leakage of such fluid out of the pump.

Each mechanical seal includes a rotating sealing ring mounted on the shaft so as to rotate therewith, and at least one stationary sealing ring, which is stationarily supported on a seal housing in opposing relation to the rotating sealing ring. One of the opposed sealing rings is axially movable so that opposing sealing faces are biased axially towards each other in sealing engagement to define a sealing region extending radially across the opposed sealing faces. The opposed sealing rings may be provided in various combinations of single or dual seals. Dual mechanical seals may be configured in one type, with axially spaced sealing rings, or in a second type, with radially spaced sealing rings wherein one or two sealing rings face two concentric, radially spaced sealing rings.

Generally in known pumps, a limited amount of process fluid may flow out of the pump chamber along the radial gaps between the shaft and head plates but such axial flow is blocked by the mechanical seals which are located axially adjacent to but spaced from the radial gaps. The mechanical seals prevent fluid from leaking along the shaft to ambient environment on the exterior of the pump.

In known configurations of this type, the operation of the pump is suitable and the mechanical seals are effective to prevent leakage. However, sliding vane pumps of this construction also exhibit fluid slip from discharge to inlet chambers within the pump chamber which reduces pump efficiency. More particularly, the head plates are located at the opposite ends of the rotor and respectively face axially toward the opposing rotor faces. Due to the relative rotation therebetween, a small axial clearance or end clearance is required between the rotor end faces and axially opposed head faces to avoid undesirable contact therebetween during shaft rotation.

Due to this end clearance, disadvantages are present. On the one hand, the opposed end faces of the rotor and head plates and the end clearances therebetween generate dynamic sealing due to the relative movement therebetween which is desirable. However, these end clearances still define fluid paths that extend face-wise across the rotor end faces and opposed head faces that allow pressurized fluid to slip from the outlet side to the inlet side of the rotor. This slip thereby reduces the overall hydraulic efficiency of the pump, since such fluid is not discharged through the outlet but instead returns to the inlet side and is then displaced again by the rotor and vanes back towards the outlet. This loss is conventionally known as slip. This slip can occur across the radial width of the rotor as defined radially from the outer shaft diameter to the outer rotor diameter.

In another aspect, the mechanical seals are located outwardly of the head plates which can increase the overall axial length of the pump. The shaft bearings in turn can be located axially outboard of the mechanical seals which also adds to the axial length of the equipment.

It is desirable to provide an improved pump and mechanical seal design which overcomes disadvantages with known sliding vane pumps and other applicable pumps.

SUMMARY OF THE INVENTION

The invention relates to a fluid pump and preferably, a sliding vane, positive displacement pump which includes a dual mechanical seal that protects against leakage from the pump chamber while also reducing slip in comparison to the above-described pump designs using head plates. According to the invention, the dual mechanical seal preferably is formed as a cartridge seal that is readily demountable from the pump for replacement and service, and is retrofittable to existing pumps to improve the performance thereof. As such, the present invention relates to a pump which integrally includes a dual mechanical seal, as well as a mechanical seal assembly provided for use with or in combination with a replaceable head ring that can be installed on existing pumps for repair thereof or for a retrofit upgrade of such existing pumps.

The pump is designed with demountable head rings, which mount to a casing to partially enclose the opposite ends of the pump chamber. The head rings preferably bolt to the pump casing and have an outer mounting portion generally similar to the above-described head plates. However, the inner portion of each head ring includes an enlarged head bore which defines an inner bore surface which is spaced radially outwardly a substantial distance from the outer shaft diameter. The head bore opens axially inwardly toward the rotor and axially outwardly towards a mechanical seal to define a seal ring pocket configured to axially cooperate with and receive the inboard end of the mechanical seal. The pump chamber therefore opens directly toward the inboard end of the mechanical seal as described further below.

The dual mechanical face seal includes a shaft-mountable drive collar and a rotating sealing ring which is radially enlarged and mounts to the drive collar so as to rotate with the shaft and pump rotor. The inboard end of the drive collar and the associated sealing ring fit axially into the head bore so that an inboard face of the sealing ring faces toward and axially contacts the respective end face of the pump rotor. All of the rotor, shaft, drive collar and rotating sealing ring rotate in unison during shaft rotation.

Preferably, the outer circumference of the rotating sealing ring faces radially outwardly toward the inner bore circumference to define a small radial clearance space which allows a limited flow of process fluid out of the pump chamber toward the mechanical seal. Alternatively, it may be desirable to provide a secondary seal feature between the outer ring circumference and inner bore circumference such as a labyrinth seal to impede leakage of process fluid through this space.

Preferably, a single rotating sealing ring is provided, which defines a pair of radially spaced, inner and outer seal faces that sealingly cooperate with a pair of concentric, radially spaced, inner and outer stationary seal rings. The inner and outer stationary sealing rings have respective inner and outer sealing faces that are concentrically located to one another on the same plane for sealing contact with the opposed seal faces of the rotating sealing ring. Preferably, the stationary sealing rings are formed of carbon and do not rotate during shaft rotation such that the sealing faces are stationary in relation to the rotating sealing ring on the shaft. The rotating sealing ring may be formed of a harder material such as a suitable metal, silicon carbide or tungsten carbide or other suitable material.

The sealing faces of the stationary sealing rings contact or sealingly cooperate with the respective rotating sealing face sections so as to define radially spaced, inner and outer sealing regions. Preferably, the stationary sealing rings are axially movable and biased by springs or other biasing means to allow for sealing and wear of the stationary sealing rings independent of each other. The sealing faces may also be designed for non-contacting, dynamic sealing.

The stationary sealing rings are concentric but radially spaced apart to define an intermediate seal chamber so that the respective inner and outer sealing regions are separated by a pressurized barrier fluid (typically oil) wherein the barrier fluid is contained and pressurized using an external barrier fluid system. The barrier fluid may be a fluid other than oil including other liquids or gases. This pressurization of the barrier fluid acts on and biases the rotating sealing ring axially into contact against the end face of the pump rotor. This axial contact thereby eliminates any clearance space across the radial extent of the back face the sealing ring, which back extends from the shaft to the outer ring diameter. This ring-to-rotor contact thereby prevents the occurrence of slip in this region which provides improved efficiency relative to known pump designs.

In addition to the barrier fluid pressure, the process fluid and the discharge pressure thereof may also migrate through the radial gap between the rotating sealing ring and head bore into the region of the outer sealing ring, wherein the discharge pressure further assists in biasing or urging the rotating seal ring toward the pump rotor. This also helps to improve hydraulic efficiency in the pump by the reduction of slip.

As an additional advantage, the concentric, radially-spaced sealing rings in combination with the single rotating sealing ring allows for a small axial package for a cartridge seal which in turn allows for a small distance between pump bearings. This minimization of the bearing-to-bearing distance allows for lower shaft deflection under load, the use of standard pump components, and retrofitting of the inventive mechanical seal to pumps that are already in service and have a conventional head plate. The inventive head ring and mechanical seal assembly can be installed on existing pumps by removing an existing head plate and replacing with the inventive head ring. The inventive mechanical seal is preferably a cartridge design which can be mounted to the head ring. With these components, the head ring and mechanical seal can be replaced/serviced without disturbing existing pump piping for barrier fluids or the radial location of the rotor.

Further, one size of the mechanical seal may be used for multiple pump sizes/models merely by varying the size of the head ring that is provided in combination with the mechanical seal assembly. In this regard, the outer dimension of a known head plate would vary with different size pumps, and the inventive head ring would be designed with equivalent outer dimensions while the inner bore would remain the same so as to match the mechanical seal size. Hence, the mechanical seal can readily mate with a variety of head ring sizes, allowing for manufacture and retrofit installation on a variety of pump sizes.

Other objects and purposes of the invention, and variations thereof, will be apparent upon reading the following specification and inspecting the accompanying drawings.

Figure 1:
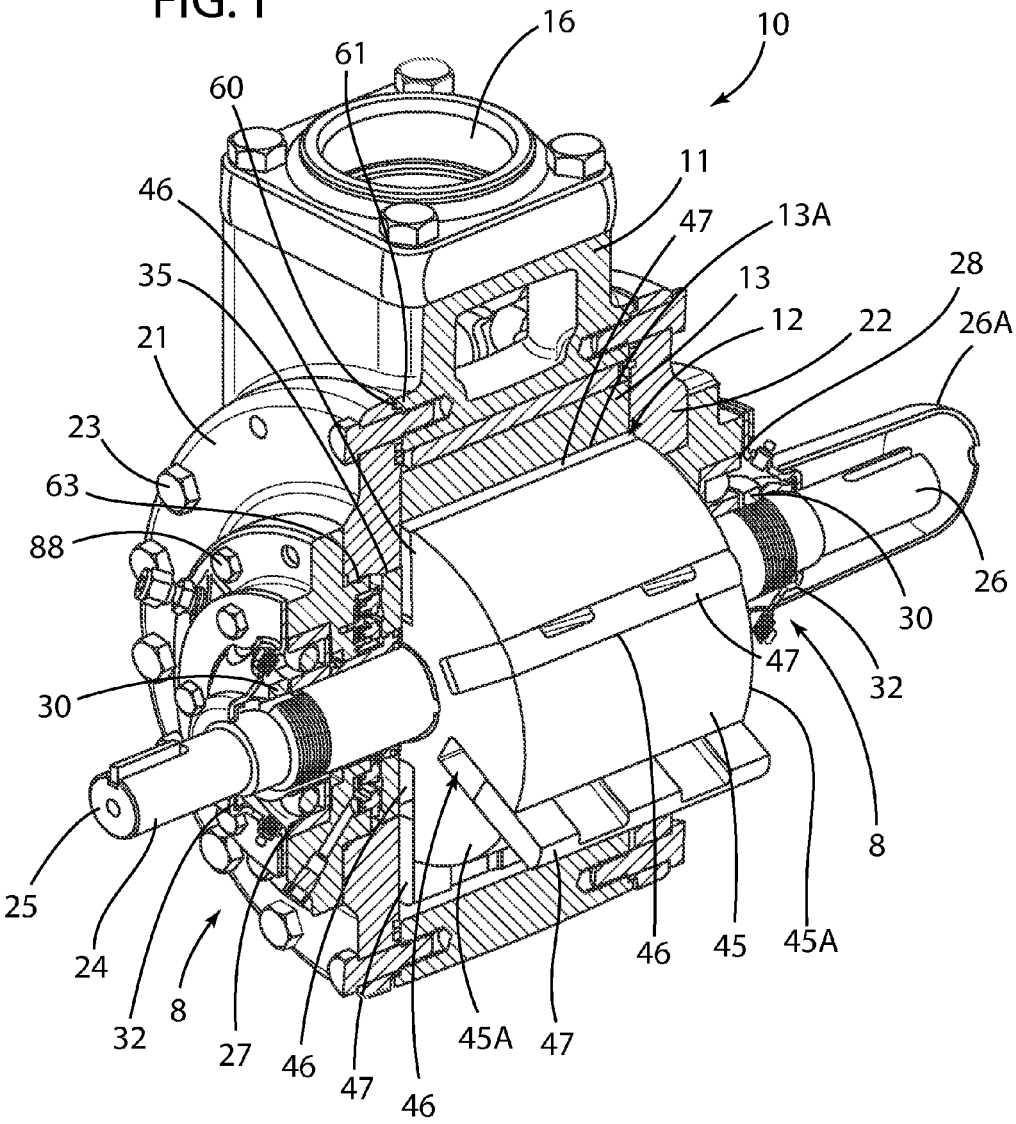
FIG. 1 is a partially cut-away, perspective view of an inventive positive displacement pump with sliding vanes as taken through a vertical cutting line.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
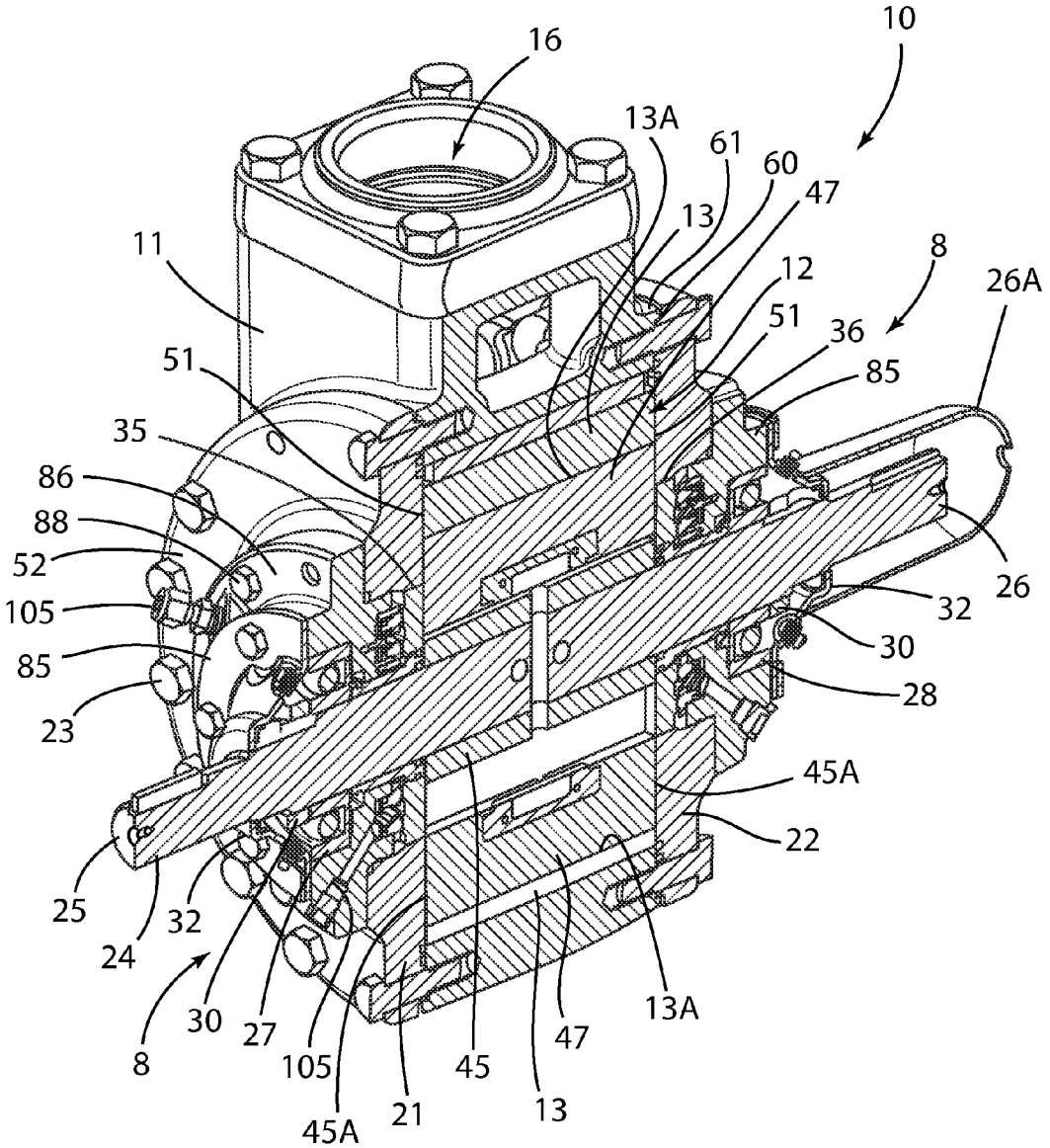
FIG. 2 is a partially cut-away, perspective view of the positive displacement pump of FIG. 1 with the rotor assembly being cut away.
Figure 3:
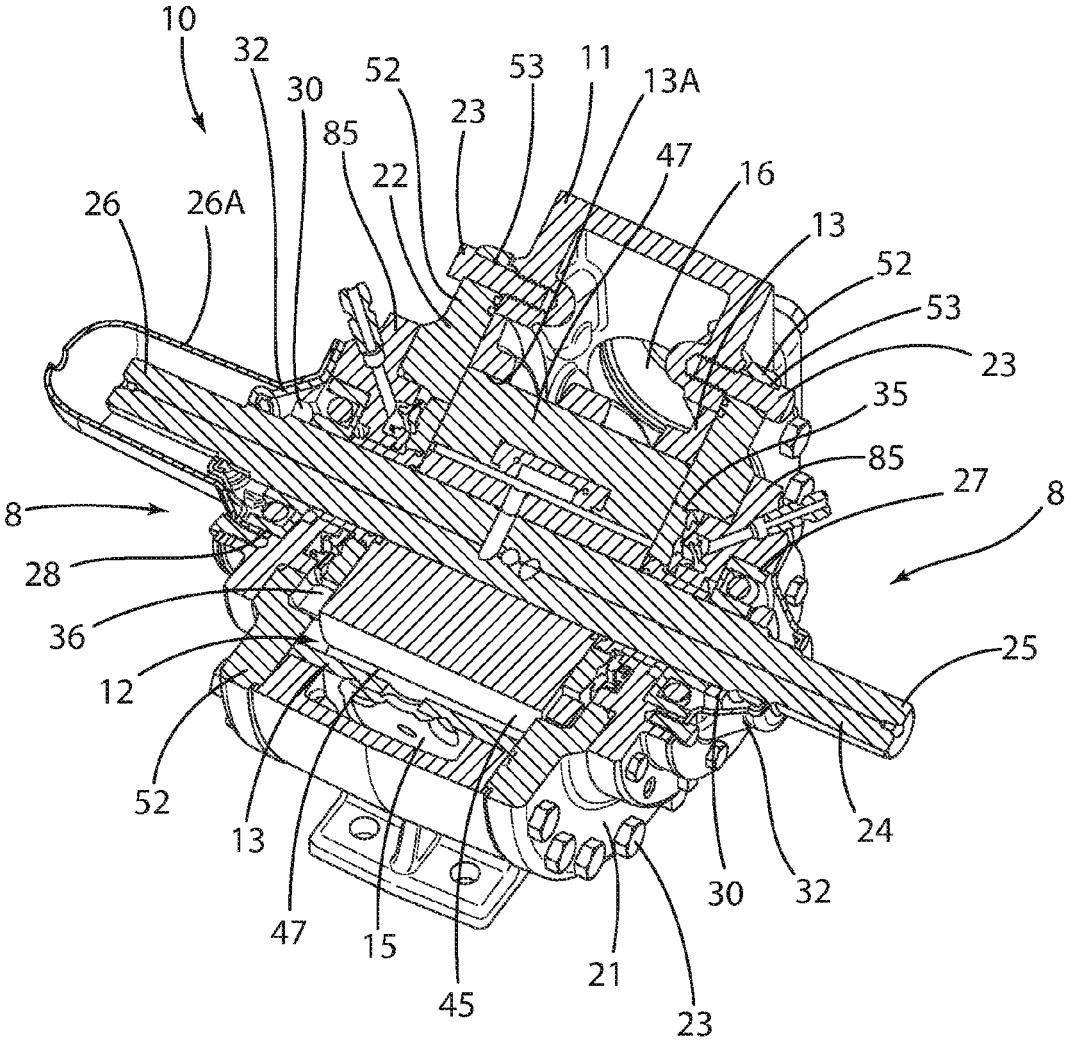
FIG. 3 is a partially cut-away, perspective view of the positive displacement pump of FIG. 1 as taken through a horizontal cutting line.

Referring to FIGS. 1-3, the invention relates to a dual mechanical seal 8 which is provided as part of a fluid pump 10 and preferably, a sliding vane, positive displacement pump that reduces slip in comparison to known pump designs. According to the invention, the dual mechanical seal 8 preferably is formed as a cartridge seal that is readily demountable from the pump 10 for replacement and service, and is retrofittable to existing pumps to improve the performance thereof. As such, the present invention relates to a pump 10 which integrally includes a dual mechanical seal 8, as well as a mechanical seal assembly 8 provided for use with or in combination with a replaceable pump components that can be installed on existing pumps for repair thereof or for a retrofit upgrade of such existing pump.

Turning first to the pump components that define a pumping assembly, the inventive sliding vane pump 10 includes a housing or casing 11 that defines a hollow section which is shaped to define a pump chamber 12. Typically, the pump chamber 12 is defined by a liner 13 that is stationarily supported in the casing 11 and has an eccentric, non-circular cross-sectional profile defined by liner surface 13A. As seen in FIG. 3, the pump chamber 12 is supplied with process fluid through an inlet 15 and discharges from an outlet 16, which inlet 15 and outlet 16 respectively open into and out of the pump chamber 12.

In FIGS. 1-3, at least one and preferably both of the opposite ends of the chamber 12 open from the casing 11, but are partially enclosed by a first head ring 21 and a second head ring 22. The first and second head rings 21 and 22 are affixed to the casing 11 by fasteners 23 and sandwich the liner 13 therebetween so as to prevent axial liner movement during shaft rotation.

Figure 4:
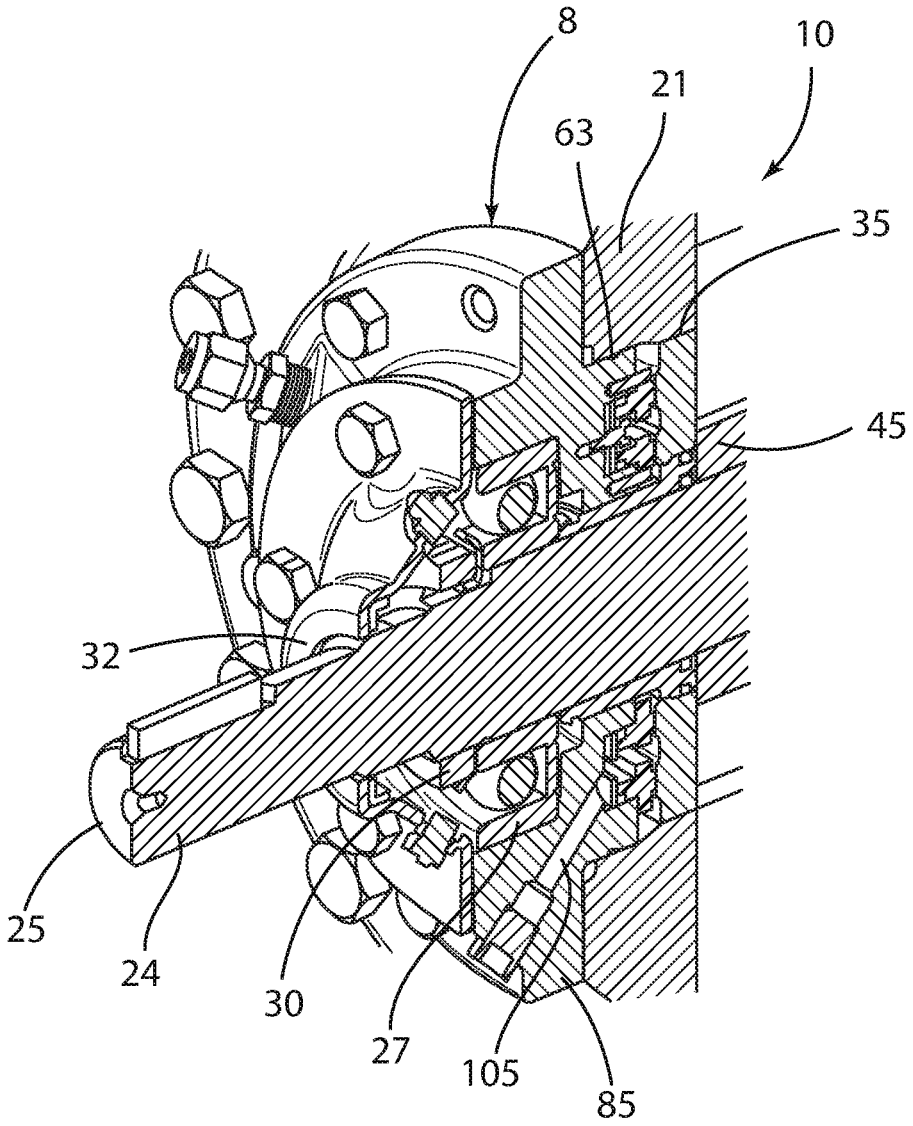
FIG. 4 is an enlarged perspective view in cross-section showing one end of the pump and a mechanical seal assembly thereof.
Figure 5:
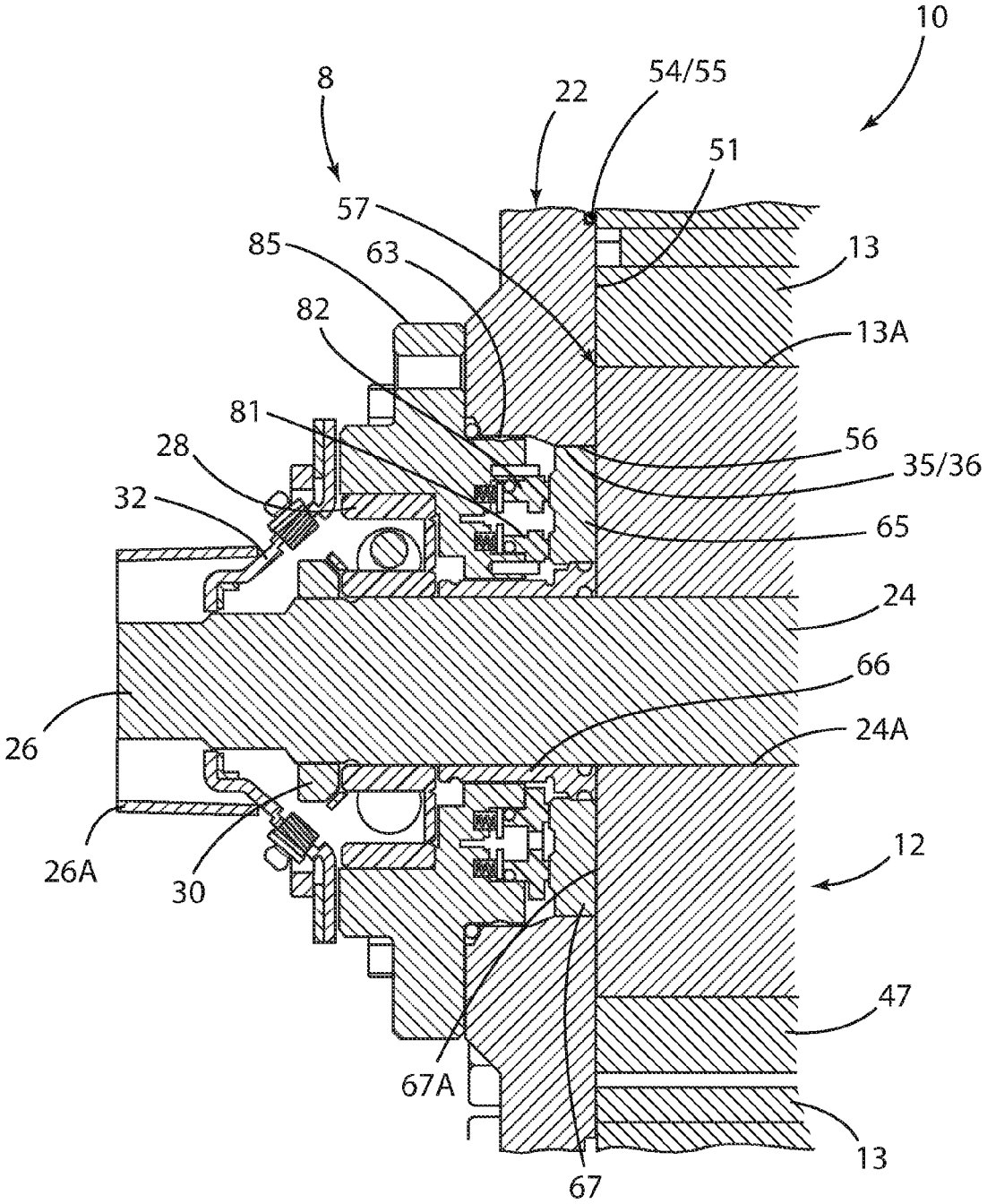
FIG. 5 is a side cross-section view of the inventive pump.

A shaft 24 extends through the casing 11 and has a first end 25, which projects outwardly from the casing 11 and is driven by a motor or other motive means, and a second end 26, which projects outwardly and is enclosed by a cover 26A. Referring to FIGS. 1 and 2, the shaft ends 25 and 26 are supported by bearings 27 and 28 which are respectively supported within respective mechanical seal assemblies 8 so as to rotatably support the shaft 24 to permit rotation thereof. Referring to FIGS. 4 and 5, the bearings 27 and 28 are retained axially in position by bearing locknuts 30, which thread onto the shaft ends 25 and 26, and in turn, are enclosed, by bearing covers 32, which are removably affixed in position.

Generally turning to FIGS. 1-3, the shaft 24 extends through the pump chamber 12 by extending axially through head bores 35 and 36 which are formed in the center of the head rings 21 and 22. To prevent process fluid from leaking axially out of the pump chamber 12 along the shaft 24, mechanical seals 8 are provided on the opposite ends of the shaft 24 which seal radially between the head rings 21 and 22 and the shaft 24 to prevent leakage of such fluid out of the pump 10.

To effect pumping, the shaft 24 drives a rotor 45 secured to the shaft 24 so as to rotate in unison therewith. The rotor 45 is located within the pump chamber 12 to draw fluid through the inlet 15 and discharge process fluid through the outlet 16 at an elevated discharge pressure. The rotor 45 includes vane slots 46 which are spaced circumferentially from each other. These vane slots 46 open radially outwardly toward the opposing liner surface 13A, and also open axially through the opposite rotor end faces 45A toward the head rings 21 and 22.

The vane slots 46 each include a vane 47 which is movable radially inwardly and outwardly from the slots 46 in the rotor 45 so as to maintain radial contact with the liner surface 13A during shaft rotation. The vanes 47 are confined axially within the slots 46 by the head rings 21 and 22. As the shaft 24 and rotor 45 turn in unison, the volume of the space in the chamber 12 between circumferentially adjacent vanes 47 and the radially opposed surfaces of the rotor 45 and liner 13 (each space referred to as a fluid cavity), cyclically increases and decreases due to the eccentric profile defined by inner liner surface 13A.

As a result of the increase in volume of a fluid cavity as it begins to travel away from the inlet 15, a suction is formed in the cavity. The suction draws process fluid into the fluid cavity through the inlet 15. As the rotor 45 continues to turn, owing to the geometry of the pump chamber 12 and liner 13, the volume of the fluid cavity decreases as it travels towards the outlet 16. As a result of the volume of the cavity decreasing, the process fluid in the cavity is discharged through the outlet 16 at an elevated discharge pressure.

Referring to the head rings 21 and 22 shown in FIGS. 2 and 5, the liner 13 and head rings 21 and 22 remain stationary while the rotor 45 rotates relative thereto. The head rings 21 and 22 are located at the opposite ends of the rotor 45 and respectively include interior ring faces 51 which face axially in inboard directions toward the opposing rotor end faces 45A. Due to the relative rotation therebetween, a small axial clearance or end clearance is provided between the head ring faces 51 and the rotor faces 45A. Typically, the head rings 21 and 22 and the rotor 45 are metallic, and as such, contact must be avoided during shaft rotation, wherein such face contact can cause galling between these components.

Due to this end clearance, the opposed ring faces 51 and rotor end faces 45A generate dynamic sealing due to the relative movement of the rotor end faces 45A as will be described in greater detail relative to the head rings 21 and 22 discussed below. As a result, the dynamic movement of the components impedes leakage of fluid between these opposing faces 51 and 45A. However, these end clearances still define fluid paths that extend face-wise across the outer portion of the end faces 45A disposed opposite to the ring faces 51. These fluid paths allow some pressurized fluid to slip from the outlet side to the inlet side of the rotor 45. This slip reduces the overall hydraulic efficiency of the pump 10, since such fluid is not discharged through the outlet 16 but instead returns to the inlet side and is then displaced again by the rotor 45 and vanes back towards the outlet 16.

Figure 8:
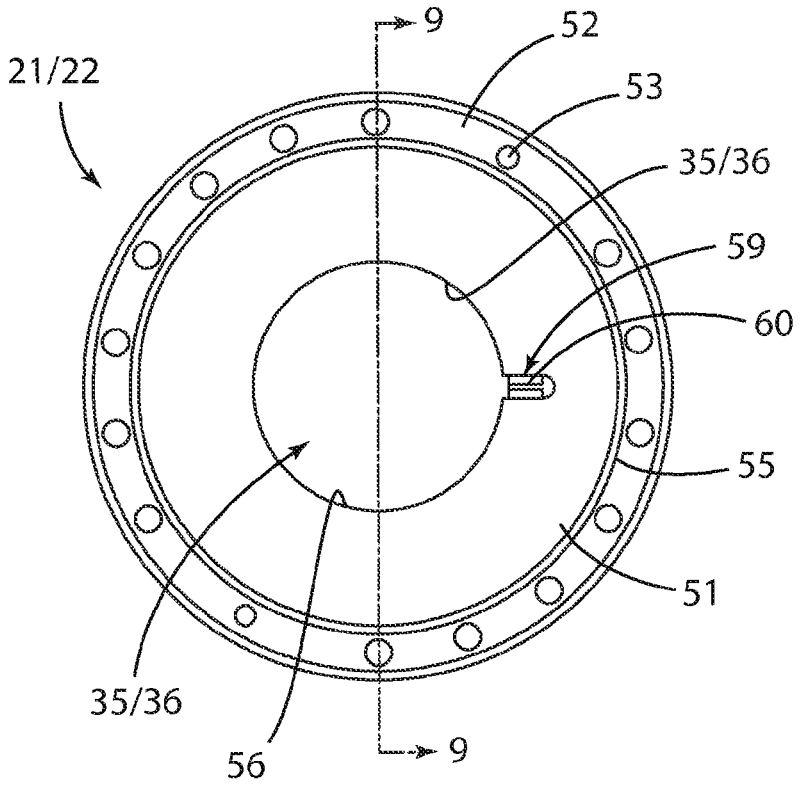
FIG. 8 is a front view of a head ring.
Figure 9:
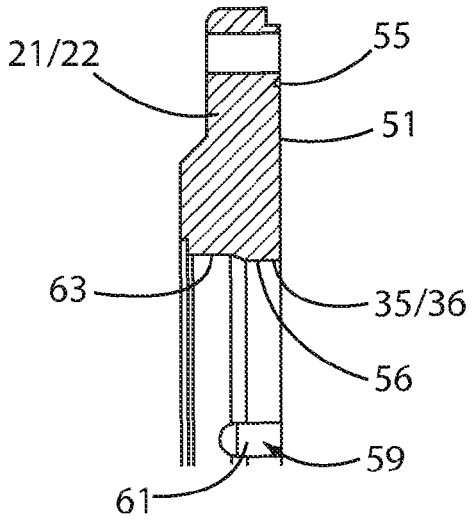
FIG. 9 is a partial cross-section view of the head ring as taken through line 9-9 of FIG. 8.

In this inventive design, however, the slip zone defined between the rotor 45 and head rings 21 and 22 is limited to the outer portion of the rotor 45. More particularly as to the head ring 21/22 shown in FIGS. 8 and 9, the outer portion of each head ring 21/22 includes a mounting flange 52 which includes bolt holes 53 that receive the above-described bolts 23 therethrough. The mounting flange 52 overlaps the side faces of the casing 11 as seen in the figures including FIG. 3 and prevents fluid leakage therebetween through a secondary seal which preferably is an o-ring 54 (FIG. 5) received in an o-ring groove 55 (FIGS. 5, 8 and 9).

The inner portion of the head ring 21 extends inwardly of the o-ring groove 55 and defines an inner ring surface 56 which defines the head bores 35/36 of the head rings 21/22. As will be described, the inner ring surface 56 cooperates with the mechanical seal 8, and thereby will define the inner limit of the slip zone across which slip may occur. More specifically, slip may occur from the inner ring surface 56 outwardly to the liner surface 13A at the radial location indicated by reference arrow 57 in FIG. 5. Due to the liner 13 being sandwiched between the head plates 21 and 22, very little process fluid can leak beyond slip limit 57, and ultimately, any such leakage would be blocked by gasket 54. Therefore, hydraulic slip is restricted to the slip zone that is bounded on the inside by the inner ring surface 56 and on the outside by the liner surface 13A at slip limit 57. This substantially reduces slip in comparison to known pump designs as will be discussed below.

While minimization of slip is desirable, the head ring 21/22 also may be configured to allow some flow of process fluid to the outboard side of the head ring 21/22 for use by the mechanical seal 8. Referring to FIGS. 8 and 9, the head ring 21/22 includes a feed groove 59 which has a radial groove section 60 formed in the head ring face 51, and an axial groove section 61 formed in the inner ring surface 56. This feed groove 59 thereby can be used to provide process fluid at the discharge pressure to the mechanical seal 8 to improve the performance thereof as described below.

To radially locate the head rings 21/22 relative to the pump casing 11, each head ring 21/22 includes an annular formation preferably formed as an annular notch 60 which fits with a complementary lip 61 on the casing 11. The notch 60 and lip 61 radially aligns the head rings 21/22 with the casing 11 and pump chamber 12. To mate the head rings 21/22 with the mechanical seal 8, the head ring 21/22 also includes a housing pocket 63 on the outboard side of the ring bore 35/36. The housing pocket 63 is stepped larger than the ring bore 35/36 so as to engage with the mechanical seal 8 in fixed engagement therewith and radially locate the mechanical seal 8 relative to the head rings 21/22 and pump casing 11.

With respect to the following disclosure as to the mechanical seal 8, it will be understood that the head ring 21/22 and respective mechanical seal 8 can be designed for original installation in a pump 10, or can be provided in combination to retrofit an existing pump to replace out existing head plates and mechanical seals with head rings 21/22 and mechanical seals 8 of the present invention. In known pumps, the outer dimension of a known head plate would vary with different size pumps. The inventive head ring 21/22 therefore can be designed with the mounting flange 52 matching the bolt pattern and dimensions of a head plate being replaced. While the head ring 21/22 would be designed with equivalent outer dimensions, the head bore 35/36 would remain the same in different sized head rings 21/22 so that a common size for the mechanical seal 8 can be used. Hence, the mechanical seal 8 can readily mate with a variety of head ring sizes for the head ring 21/22, allowing for manufacture and retrofit installation on a variety of pump sizes.

Figure 6:
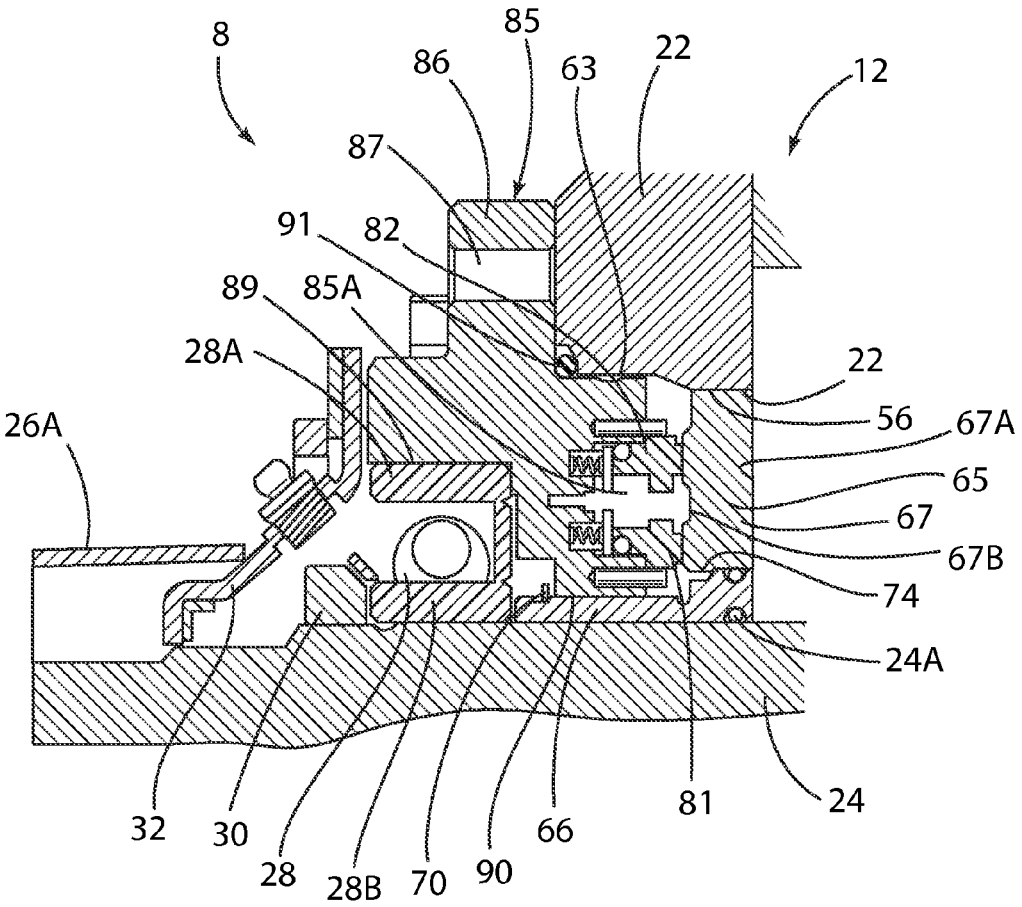
FIG. 6 is an enlarged side cross-section view thereof showing the mechanical seal and bearing assembly.

Next as to the mechanical seal 8 shown in FIGS. 5 and 6, the mechanical seal 8 preferably is formed as a dual mechanical seal that protects against leakage from the pump chamber 12 while also reducing slip in comparison to known pump designs. According to the invention, the dual mechanical seal 8 preferably is formed as a cartridge seal that is readily demountable from the pump 10 for replacement and service, and yet this design is also retrofittable to existing pumps to improve the performance thereof.

As referenced above, the head rings 21/22 each include a respective head bore 35/36. While FIGS. 5 and 6 show the mechanical seal 8 at the second shaft end 26 which cooperates with the head ring 22, it will be understood that the head rings 21/22 and mechanical seals 8 are identical at both shaft ends 25 and 26 and the description of one applies to the other.

As previously described, the inner portion of each head ring 21/22 includes an enlarged head bore 35/36 which defines an inner bore surface 56. As shown in FIGS. 5 and 6, the inner bore surface 56 is spaced radially outwardly a substantial distance from the outer shaft diameter 24A. When the head ring 21/22 is mounted to the shaft 24, the head bore 35/36 opens axially inwardly toward the rotor 45 and outwardly towards the mechanical seal 8 to define a seal ring pocket 65 configured to axially cooperate with and receive the inboard end of the mechanical seal 8 as described below. The pump chamber 12 therefore opens outwardly toward each of the mechanical seals 8.

More particularly as to the mechanical seal 8, the mechanical seal 8 preferably is formed as a dual mechanical face seal, which includes a shaft-mountable drive collar 66 and a rotating sealing ring 67 which is radially enlarged and mounts to the drive collar 66 so as to rotate with the shaft 24 and pump rotor 45. The inboard end of the drive collar 66 and the associated sealing ring 67 fit axially into the head bore 35/36 so that an inboard or back face 67A of the sealing ring 67 faces toward and axially contacts the opposing end face 45A of the pump rotor 45. All of the rotor 45, shaft 24, drive collar 66 and rotating sealing ring 67 rotate in unison during shaft rotation.

Figure 7:
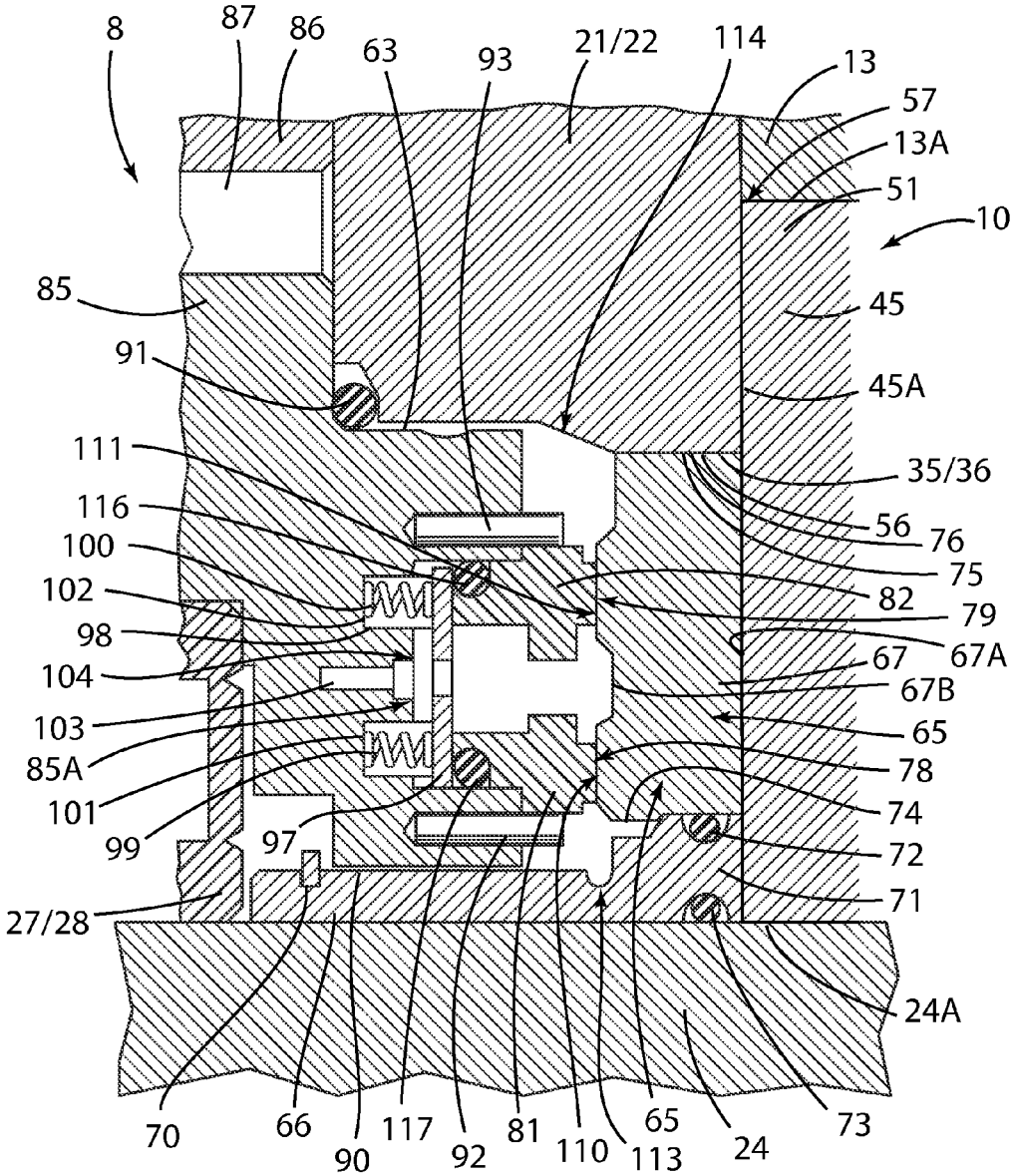
FIG. 7 is an enlarged side cross-section view of the mechanical seal.
Figure 10:
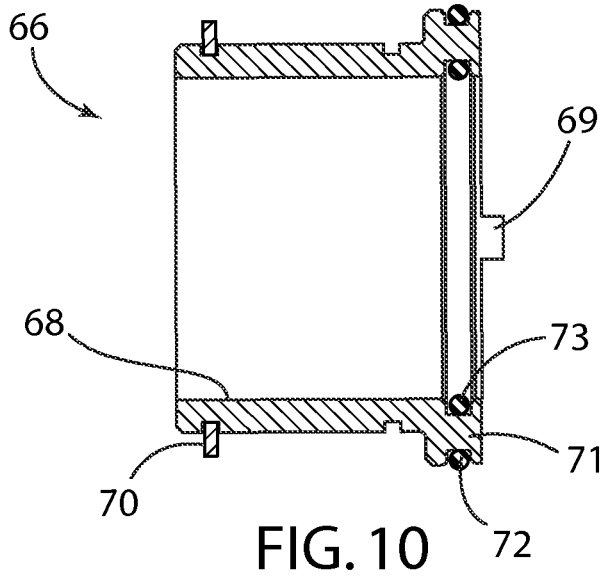
FIG. 10 is a side cross-section view of a drive collar.

Turning to FIGS. 7 and 10, the drive collar 66 is formed as a cylinder which has a shaft bore 68 that slides over the shaft 24. The drive collar 66 includes tangs 69 that project axially and can seat within recesses in the rotor end face 45A so that the drive collar 66 and sealing ring 67 rotate with the shaft 24 and rotor 45. It is understood that other securing means may be provided to ensure that the drive collar 66 rotates in unison with the shaft 24, such as set screws or the like.

When mounted to the shaft 24, the drive collar 66 is confined axially between the rotor 45 on the inboard collar end and the bearing 27/28 on the outboard collar end. The outboard collar end also includes a retainer ring 70 and associated groove which axially joins the drive collar 66 to the remainder of the mechanical seal components in a cartridge seal assembly. The retainer ring 70 is preferably formed as a clip ring or snap ring, which is snapped in place, after the sealing ring 67 is mounted to the drive collar 66.

The drive collar 66 has an annular mounting flange 71 on the inboard end for mounting of the rotating sealing ring 67 thereto, as well as a secondary seal such as O-ring 72 to prevent leakage therebetween. Further, an inner secondary seal formed as an O-ring 73 is provided in the shaft bore 68 to prevent leakage of process fluid along the shaft 24.

Next as to the rotating sealing ring 67, the inner ring diameter 74 of the sealing ring 67 is stepped so as to mount on the collar mounting flange 71 and prevent axial removal of the sealing ring 67 in the inboard axial direction. This structural mating of the stepped, inner ring diameter 74 with the collar mounting flange 71 functions to prevent axial separation of the sealing ring 67 while permitting some axial movement of the sealing ring 67, particularly toward the rotor 45 when the mechanical seal 8 is pressurized.

The inner ring portion of the sealing ring 67 is shaped with flats at circumferentially spaced locations that mate with corresponding flats formed about the outer diameter of the collar mounting flange 71. These cooperating flats prevent rotation of the sealing ring 67 relative to the drive collar 66 so that the sealing ring 67 and drive collar 66 rotate together in unison during shaft rotation.

When the sealing ring 67 is mounted to the drive collar 66 and installed in the pump 10, the sealing ring 67 is located within the seal ring pocket 65 defined between the inner bore surface 56 and the inner ring diameter 74 of the rotating sealing ring 67. The outer ring diameter 75 defines an outer ring surface 76 which faces radially outwardly toward the inner bore circumference defined by surface 56 to define a small radial clearance space which allows a limited flow of process fluid out of the pump chamber 12 and axially past the rotating sealing ring 67. Alternatively, it may be desirable to provide a secondary seal feature between the outer ring surface 76 and inner bore surface 56 such as a labyrinth seal to impede leakage of process fluid through this radial space.

Preferably, the rotating sealing ring 67 is provided as a single monolithic ring having an outboard ring surface 67B which includes a pair of radially spaced, inner and outer rotating seal faces 78 and 79 that sealingly cooperate with a pair of concentric, radially spaced, inner and outer stationary seal rings 81 and 82 which will be described in further detail below. The inner and outer seal faces 78 and 79 are concentric to each other and axially raised so as to project a small distance toward the stationary sealing rings 81 and 82 and lie in a common radial plane.

The rotating sealing ring 67 may be formed of a hardened steel, but can also be made from other materials such as silicon carbide or tungsten carbide. Alternatively, the sealing ring 67 can be coated over the seal faces 78 and 79 to achieve a higher hardness than the base or substrate material of sealing ring 67 and stationary sealing rings 81 and 82. If desired, the sealing ring 67 may be formed of a first material, and the seal faces 78 and 79 defined by harder, ring-shaped inserts embedded within the body of the sealing ring 67 to help control cost. Preferably, the ring material is a thermally conductive material that facilitates the transfer of heat away from the seal faces 78 and 79 and toward the process fluid flowing about the sealing ring 67.

Figure 11:
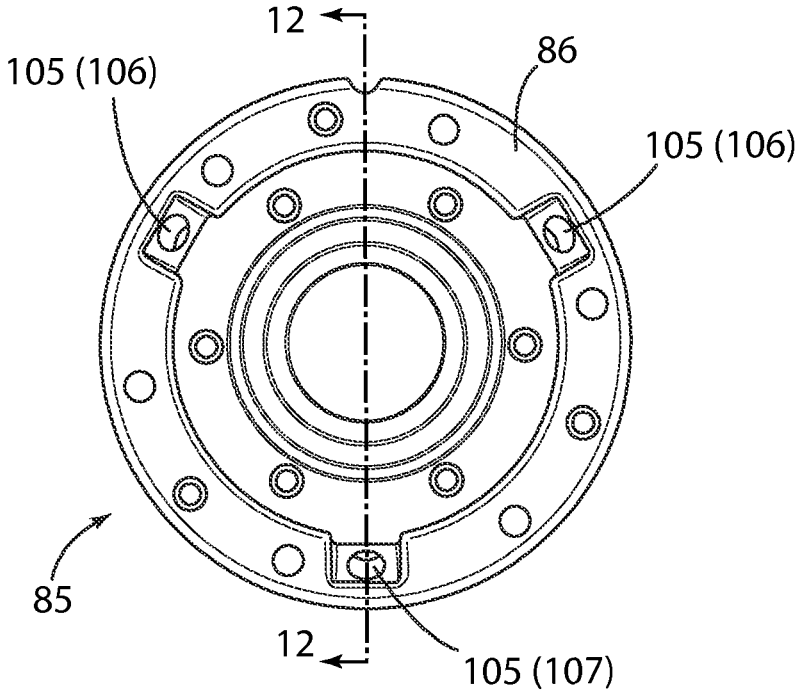
FIG. 11 is a front view of a seal housing.
Figure 12:
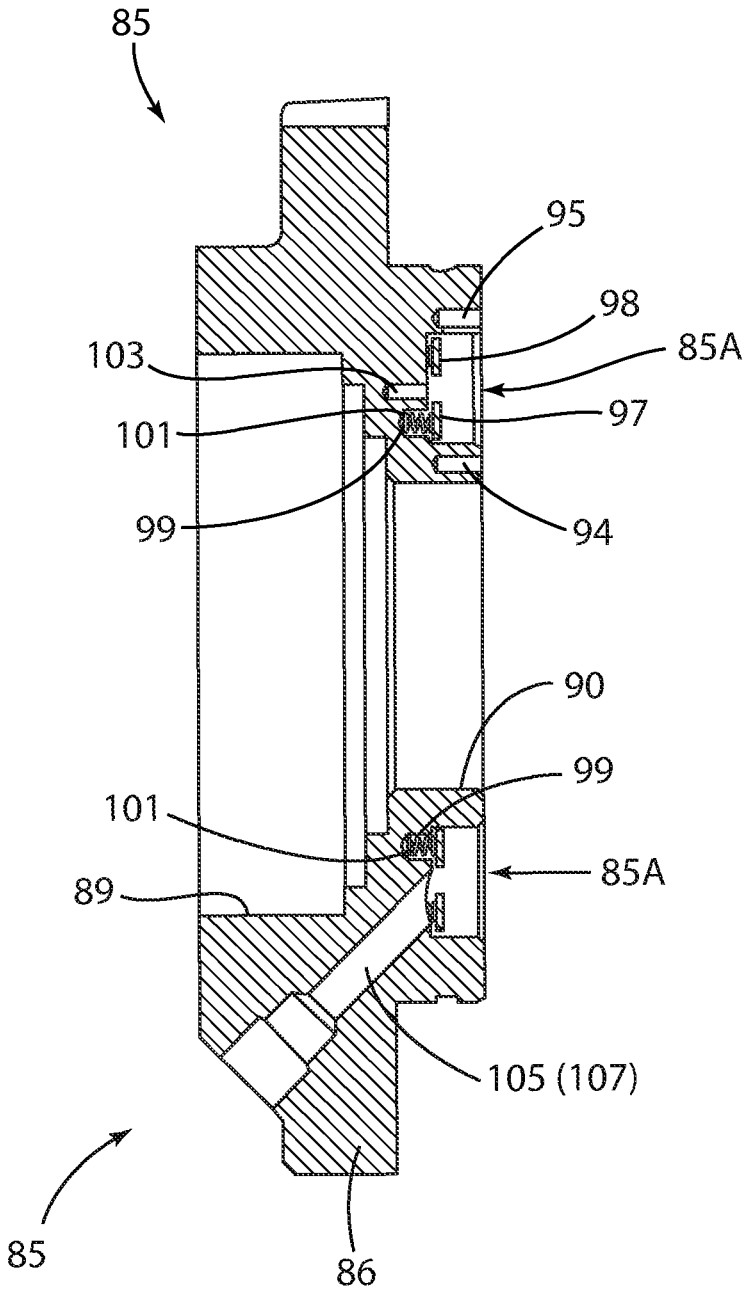
FIG. 12 is a cross-section view of the seal housing as taken along line 12-12 of FIG. 11.

Next, referring to FIGS. 6, 11 and 12, the stationary sealing rings 81 and 82 are supported in an annular insert cartridge which serves as a seal housing 85. The seal housing 85 includes a mounting flange 86 that has fastener holes 87 which receive fasteners 88 (FIG. 1) that in turn engage the respective head ring 21/22. An inboard end of the seal housing 85 fits snugly into the housing pocket 63 of the head ring 21/22, wherein this cooperation of the seal housing 85 with the head ring 21/22 radially locates the seal housing relative to the head rings 21/22 and the sealing rings 81 and 82 relative to the pump components and shaft 24.

On the outboard housing end as seen in FIG. 6, a bearing pocket 89 is provided which receives the stationary race 28A of the bearing 28, while the rotating race 28B rotates with the shaft 24. The other bearing 27 similarly mounts in a respective seal housing 85 at the opposite shaft end 25. The bearings 27/28 are confined axially within the respective bearing pockets 89 by the bearing locknuts 30 which are threaded onto the shaft 24 as described above. The bearing pocket 89 provides for the precise radial location of the bearings 27 and 28 and thus the shaft 24 when assembled, and in turn radially locates the rotor 45 within the pump chamber 12.

The inboard end of the seal housing 85 includes an inner bore 90 which slides over the shaft 24 and drive collar 66 and defines a small radial clearance or gap therebetween. This allows external ambient pressure, typically at atmospheric pressure, to migrate past the bearings 27/28 and reach the inner ring diameter 74 of the rotating sealing ring 67. When mounted in position, the seal housing 85 includes a secondary seal formed as an O-ring 91 (FIG. 6) which seals against the head ring 21/22 and prevents seal leakage from the region of the housing mounting flange 86. This O-ring 91 provides a static seal between the process fluid at the outside circumference of the sealing ring 67 and atmospheric pressure on the exterior of the pump 10.

Referring to FIGS. 7 and 12, the inboard end of the seal housing 85 includes an annular ring channel 85A which opens axially toward the rotating sealing ring 67 and is sized axially and radially to receive the stationary sealing rings 81 and 82 therein. Generally, the sealing rings 81 and 82 are held stationary or non-rotatable relative to the seal housing 85 but are axially movable toward the rotating sealing ring 67 so as to maintain sealing engagement therewith. Preferably, the sealing rings 81 and 82 are formed of a material that is less hard than the rotating sealing ring 67. Preferably, such material is carbon which is commonly used in mechanical seals although other materials may be used.

To maintain the sealing rings 81 and 82 stationary relative to the sealing ring 67 which rotates with the shaft 24, circumferentially spaced, inner and outer drive pins 92 and 93 (FIG. 7) are fixed in pin bores 94 and 95 ((FIG. 12) such as by an interference fit or adhesive. The drive pins 92 and 93 engage corresponding drive notches on the inner and outer diameters of the sealing rings 81 and 82 to prevent relative rotation while permitting axial movement thereof. Axial movement may occur due to operating conditions, such as shaft vibrations, or due to seal face wear of the sealing rings 81 or 82, which are not as hard as the material of the sealing ring 67. Other drive means may also be provided.

To effect axial seal movement, each of the sealing rings 81 and 82 has a respective backing plate 97 or 98, which abuts against a ring back face on one side and a plurality of circumferentially spaced springs 99 and 100 on the other side. The inner and outer springs 99 and 100 project out of corresponding spring bores 101 and 102 in the seal housing 85 as seen in FIG. 7, and bias the sealing rings 81 and 82 axially toward the rotating sealing ring 67. The springs 99/100 generate an axial load or biasing force on the stationary sealing rings 81/82 to ensure contact with rotating sealing ring 67 during low pressure conditions. It will be appreciated that other biasing means may also be provided.

The inner and outer backing plates 97 and 98 axially retain the inner and outer springs 99 and 100 when assembled, and translate individual spring forces into a more even distribution onto the carbon sealing rings 81 and 82. The backing rings 97 and 98 may be formed as flat discs out of stainless steel but can be made from other materials depending on application. During assembly, backing ring retaining screws may be threaded into corresponding bores 103 (FIGS. 7 and 12) in the ring channel 85A to retain the backing plates 97/98 and springs 99/100 during assembly or disassembly. The retaining screws are formed as shoulder screw wherein the screw head interferes with the backing plates 97/98 and axially restricts movement during assembly. When the seal 8 is installed, the sealing rings 81 and 82 move deeper into the ring pocket 92, the springs 99/100 are compressed and the backing plates 97/98 move in the outboard direction so as to no longer contact the retaining screw head.

Generally, after the mechanical seal 8 is preassembled and before it is installed on the pump 10, the stationary sealing rings 81 and 82 project axially from the ring channel 85A and contact the rotating sealing ring 67. The drive collar 66 is restrained axially and secured to the seal housing 85 by the retaining ring 70 described above to prevent axial separation of the drive collar 66 from the seal housing 85. The sealing ring 67 is mounted on the collar mounting flange 71 and axially holds the abutting sealing rings 81 and 82 within the seal channel 92. As such, all of the seal components can be pre-assembled into a cartridge assembly that can be mounted and demounted from the pump 10 as a unitized assembly. This allows for easy replacement of a mechanical seal 8 while the pump 10 is in place.

The seal housing 85 also serves to provide an interface for a barrier fluid system to pressurize the area disposed radially between sealing rings 81 and 82 with a barrier fluid. The barrier fluid preferably is oil although other suitable barrier fluids may be other liquids or gases. In this regard, the seal housing 85 includes a plurality of fluid ports 105 which are circumferentially spaced and open into the radial space between the sealing rings 81 and 82 which forms an intermediate sealing chamber 104. The ports 105 include external fittings which releasably connect to a barrier fluid system. Preferably, the two uppermost ports 105 serve as discharge ports 106 (FIG. 11) and the bottommost port 105 serves as an in feed port 107. This allows for barrier fluid circulation due to thermo-siphon and provides a pressurized barrier fluid to the sealing chamber 104, which said barrier fluid preferably is at a higher pressure than the discharge pressure of the process fluid. When this radial space is pressurized, this serves to bias the rotating sealing ring 67 axially against the rotor 45 as described further herein.

The construction of the seal housing 85 allows for easy rebuild since it serves as a locating feature for the seal point of the pump 10 which is undisturbed. Also, the seal housing 85 allows for the connection of barrier fluid through the three ports 105. Further, integration of the seal pocket 92 with the sealing rings 81 and 82 arranged concentric to each other allows for a small axial package to allow for retrofit with pre-existing pumps.

More particularly as to FIG. 7, the inner and outer stationary sealing rings 81 and 82 have respective inner and outer sealing faces 110 and 111 that are concentrically located on the same plane for sealing contact or engagement with the opposed seal faces 78 and 79 of the rotating sealing ring 67. Preferably, the stationary sealing rings 81 and 82 are axially movable but stationary in relation to the rotating sealing ring 67 during shaft rotation.

The stationary sealing faces 110 and 111 cooperate with the rotating sealing faces 78 and 79 to thereby define radially-spaced, inner and outer sealing regions which lie in a common plane. The stationary sealing rings 81 and 82 are concentric but radially spaced apart to define the intermediate seal chamber 104. Also, inner and outer seal spaces 113 and 114 are defined radially inwardly and outwardly of the sealing rings 81 and 82 so that the respective inner and outer sealing spaces 113 and 114 form respective fluid chambers that are separated by the pressurized barrier fluid chamber 104.

On the outside, the outer sealing space 114 is pressurized by the process fluid at the discharge pressure due to the flow of such process fluid between the outer ring surface 76 and the inner bore surface 56. This fluid flow is assisted by the feed passage 59 provided in the head ring 21/22. This discharge pressure typically is less than the barrier fluid pressure in seal chamber 104.

On the inside, the inner sealing space 113 is at external ambient pressure, which is less than the barrier fluid pressure. Typically, ambient pressure is at atmospheric pressure.

In one aspect, the pressurization of the barrier fluid acts on and biases the inboard back face 67A of the rotating sealing ring 67 into contact against end face 45A of the pump rotor 45. This abutting contact eliminates any clearance space across the radial extent of the back face of the sealing ring 67, which back extends from the shaft 24 and drive collar 66 to the outer ring diameter 75. This ring-to-rotor contact thereby prevents the occurrence of slip across this region of the rotor end face 45A which provides improved hydraulic efficiency for the pump 10.

In addition to the barrier fluid pressure, the process fluid and the discharge pressure thereof may also migrate into the outer sealing space 114, wherein the discharge pressure further biases the outer portion of the rotating seal ring 67 toward the pump rotor 45. This also helps to improve hydraulic efficiency in the pump 10 by helping to press the sealing ring 67 against the rotor 45 and reduce slip.

With this arrangement, the outer sealing ring 82 serves as the primary seal which is exposed to the process fluid discharge pressure on the outer diameter thereof, and is exposed to the barrier fluid pressure on the inside diameter. In more detail, a static secondary seal 116 is provided on the outboard end of the sealing ring 82 by an O-ring which defines a static separation between the discharge pressure and the barrier fluid pressure which act on the back of the sealing ring 82. On the front of the sealing ring 82 across the opposed seal faces 79 and 111, a pressure gradient is formed due to the relative rotation and the dynamic seal generated thereby. Preferably, the geometry of the sealing ring 82 and the location of the secondary seal 116 are designed such that the sealing ring 82 is lightly loaded due to the low pressure differential across the sealing ring 82. Preferably, the pressure difference between the barrier fluid pressure less the process fluid pressure is about 20 PSI. This outer sealing ring 82, while balanced, is balanced less than the inner sealing ring 81 due to the smaller load due to pressure. The sealing rings 81 and 82 are also load balanced to allow for higher pressure differential between the barrier oil system and the process fluid.

The inner sealing ring 81 serves as the secondary seal which is exposed to the barrier fluid pressure on the outer diameter thereof, and atmospheric pressure on the inside diameter. A static secondary seal 117 is provided on the outboard end of the sealing ring 81 by an O-ring which defines a static separation between the barrier fluid pressure and atmospheric pressure which act on the back of the sealing ring 81. On the front of the sealing ring 81 across the opposed seal faces 78 and 110, a pressure gradient is also formed due to the relative rotation and the dynamic seal generated thereby. Preferably, the geometry of the sealing ring 81 and the location of the secondary seal 117 are designed such that the sealing ring 81 is loaded the heaviest due to the pressure difference between the barrier fluid pressure and atmospheric or ambient environmental pressure. The sealing ring 81 is designed so that it is highly pressure balanced to reduce axial load on the seal face 110. The surface velocity between the seal faces 78 and 110 is smaller than the outer sealing ring 82 due to the smaller relative size including the diameter or circumference thereof.

This inventive design provides a number of advantages over prior art pump designs. For example, the head rings 21/22 contain the rotor 45 axially and limit internal pump leakage or slip. The head rings 21/22 axially locate the rotor 45 in relation to pumping chamber 12.

Once the head rings 21/22 are set in place, each mechanical seal 8 may be replaced and returned to the same radial location without adjustment due to the interconnection of the seal housing 85 to the head ring 21 or 22. The inside diameter defined by the inner bore surface 56 of each head ring 21/22 also locates the sealing ring 67 and is located in close proximity (concentrically) with the outer ring surface 76 of the rotating seal 67. A fluid path therebetween may provide fluid communication between pump discharge and the outer seal space 114 to insure that there is liquid at the seal faces 79 and 111 when pumping liquefied gas. This communication path may be eliminated, for example, when pumping other less volatile liquids. This fluid communication will also cool the seal faces 79 and 111.

As an additional advantage, the concentric, radially-spaced sealing rings 81 and 82 in combination with the single rotating sealing ring 67 allows for a small axial package for a cartridge seal which in turn allows for a small distance between the pump bearings 27 and 28. This minimization of the bearing-to-bearing distance allows for the use of standard pump components and retrofitting of the inventive mechanical seal 8 to pumps that are already in service and have a conventional head plate. The small bearing to bearing distance between bearings 27 and 28 allows for higher differential pressure capability in the pump 10 due to lower shaft deflections of shaft 24. The inventive head ring 21/22 and mechanical seal assembly 8 can be installed on existing pumps by removing an existing head plate and replacing with the inventive head rings 21/22. The inventive mechanical seal 8 is preferably a cartridge design which can be mounted to the head ring 21/22. With these components, each head ring 21/22 and mechanical seal 8 can be replaced/serviced without disturbing existing pump piping for barrier fluids or the radial location of the rotor.

Further, one size of the mechanical seal 8 may be used for multiple pump sizes/models merely by varying the size of the head ring 21/22 that is provided in combination with the mechanical seal assembly.

Still further, the rotating seal ring 67 is made from a thermally conductive material and has a large surface area in direct contact with the process fluid such that the ring temperature mirrors the process fluid temperature very closely. When the process fluid is cool, this draws heat away from the sealing faces 78 and 79 which can deform or damage sealing elements if they become overheated. In many cases, this heat transfer feature allows for the elimination of an external pumping/cooling system for the barrier fluid.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A pump, comprising:

a pumping assembly comprising a casing which defines a pump chamber having at least one open end, a rotatable shaft entering said pump chamber through said open end, and a rotor within said pump chamber having a rotor end face which faces said open end, said rotor being rotatably driven by said shaft to effect pumping of a process fluid, said pump assembly further including at least one head ring mounted to said casing to partially enclose said open end of said pump chamber, said head ring including a head bore which receives said shaft therethrough, and said head bore being defined by an inner bore surface spaced radially outwardly of an outer shaft surface to define a seal pocket which opens towards said rotor end face; and a mechanical seal assembly comprising:

a rotatable sealing ring which is rotatably mounted on said shaft for rotation therewith, said rotatable sealing ring being disposed within said seal pocket of said head bore with an inboard first ring surface disposed in axial facing contact with said rotor end face, said rotatable sealing ring having an opposite, outboard second ring surface facing away from said rotor and defining at least a first rotating sealing face;

a seal housing mounted to said pumping assembly;

at least a first stationary sealing ring which is non-rotatably mounted to said seal housing and defines a first stationary sealing face disposed in opposed, sealing engagement with said first rotating sealing face, said first rotating and stationary sealing faces defining a first sealing region which sealingly separates first and second fluid chambers respectively containing a first fluid and a pressurized second fluid at a pressure greater than said first fluid, said pressurized second fluid acting on said rotating sealing ring to axially bias said rotating sealing ring into contact with said rotor end face to reduce slip of said process fluid across said rotor end face.

2. The pump according to claim 1, wherein said pump is a sliding-vane positive displacement pump.

3. The pump according to claim 2, wherein said rotor includes a plurality of vane slots which are circumferentially spaced apart and open radially from a rotor surface and axially through said rotor end face, said vane slots including radially slidable vanes which reversibly slide radially outwardly into continuous contact with a chamber surface during shaft rotation and define pumping cavities circumferentially between said vanes.

4. The pump according to claim 1, wherein said second ring surface includes a second sealing face thereon wherein said first and second sealing faces are disposed in radially spaced, concentric relation, and said mechanical seal includes a second stationary sealing ring non-rotatably mounted to said seal housing, said second stationary sealing ring defining a second stationary sealing face disposed in opposed, sealing engagement with said second rotating sealing face.

5. The pump according to claim 4, wherein said second rotating and stationary sealing faces define a second sealing region which sealingly separates said second fluid chamber from a third fluid chamber.

6. The pump according to claim 5, wherein said third fluid chamber includes said process fluid therein at a process fluid pressure, and said second fluid is a barrier fluid supplied at a barrier fluid pressure greater than said process fluid pressure.

7. The pump according to claim 6, wherein said first fluid is at atmospheric pressure.

8. The pump according to claim 6, wherein said third fluid and said second fluid bias said rotating sealing ring axially into contact with said rotor end face.

9. The pump according to claim 1, wherein said head bore opens in said inboard direction toward a portion of said rotor end face and said rotating sealing ring abuts against said portion of said rotor end face.

10. The pump according to claim 1, wherein each opposite side of said pump bore respectively defines a said open end and includes a said head ring, each opposite side of said rotor including a said rotor end face being in contact with a said rotating sealing ring of said mechanical seal mounted to said head ring.

11. An assembly of pump components, comprising:

a head ring having a mounting flange mountable to a casing of a pump to partially enclose an open end of a pump chamber, said head ring including a head bore for receiving a pump shaft therethrough, said head bore being defined by an inner bore surface having a diameter greater than a diameter of a pump shaft wherein said pump bore defines a seal pocket which opens in an inboard direction so as to open toward a pump chamber when said head ring is mounted to a pump and which also opens in an outboard direction; and a mechanical seal assembly comprising:

a seal housing having a mounting flange removably mounted to said head ring;

a drive collar mountable to a pump shaft for rotation therewith;

a rotatable sealing ring which is mounted on an inboard collar end of said drive collar for rotation therewith, said inboard collar end and said rotatable sealing ring being disposed within said seal pocket of said head bore with an inboard first ring surface facing axially in said inboard direction, said drive collar and said rotatable sealing ring being slidably axially within said head bore, and said rotatable sealing ring having an opposite, outboard second ring surface facing in said outboard direction and defining at least a first rotating sealing face; and at least a first stationary sealing ring which is non-rotatably mounted to said seal housing and defines a first stationary sealing face disposed in opposed, sealing engagement with said first rotating sealing face, said first rotating and stationary sealing faces defining a first sealing region for sealingly separating first and second fluid chambers, said second fluid chamber opening toward said outboard second ring surface of said rotating sealing ring to permit pressurized fluid in said second fluid chamber to bias said rotating sealing ring axially in said inboard direction, said inboard first ring surface of said rotatable sealing ring projecting from said head ring for contact with a rotor end face in a pump bore.

12. The assembly according to claim 11, wherein said head bore opens through a thickness of said head ring.

13. The assembly according to claim 12, wherein said rotatable sealing ring is displaceable axially relative to said seal housing and said head ring when mounted to each other.

14. The assembly according to claim 13, wherein said head ring includes a head surface facing in said inboard direction, said first ring surface of said rotating sealing ring being disposed axially past said head surface in the inboard direction.

15. The assembly according to claim 11, wherein said second ring surface includes a second sealing face thereon wherein said first and second sealing faces are disposed in radially spaced concentric relation, and said mechanical seal includes a second stationary sealing ring non-rotatably mounted to said seal housing, said second stationary sealing ring defining a second stationary sealing face disposed in opposed, sealing engagement with said second rotating sealing face.

16. The assembly according to claim 15, wherein said second rotating and stationary sealing faces define a second sealing region which sealingly separates said second fluid chamber from a third fluid chamber.

17. The assembly according to claim 16, wherein a radial gap is defined between said rotatable sealing ring and said inner bore surface which is in fluid communication with said third fluid chamber.

18. The assembly according to claim 15, wherein said seal housing includes fluid ports which supply a barrier fluid to said second seal chamber.

19. The assembly according to claim 11, wherein said rotatable sealing ring is axially displaceable in said inboard direction when said second seal chamber is pressurized.

20. The assembly according to claim 11, wherein said seal housing includes a shaft bearing on an outboard end, said mounting flange of said head ring including fasteners and having a formation complementary to a formation on a casing for radially locating said head ring on a pump casing, and said mounting flange of said seal housing interfitting with said head ring for locating said seal housing and said bearing radially relative to said head ring.

21. A mechanical seal assembly comprising:

a seal housing having a mounting flange which is removably mountable to an equipment housing;

a drive collar mountable to a shaft for rotation therewith, said drive collar including a mounting flange which is located on an inboard collar end, said inboard collar end terminating at a collar end face which faces in an inboard direction, and said mounting flange projecting radially outwardly;

a rotatable sealing ring which is mounted on said inboard collar end for rotation therewith, said rotatable sealing ring having an inboard first ring surface facing axially in said inboard direction, said rotatable sealing ring being slidable axially in the inboard direction relative to said mounting flange so that said inboard first ring surface and said collar end face are locatable in a common plane, said rotatable sealing ring having an opposite, outboard second ring surface facing away from said rotor in an outboard direction and defining first and second rotating sealing faces wherein said first and second rotating sealing faces are disposed in radially spaced concentric relation; and concentric, radially spaced, first and second stationary sealing rings which are non-rotatably mounted to said seal housing and define respective first and second stationary sealing faces, disposed in opposed, sealing engagement with said first and second rotating sealing faces, said first rotating and stationary sealing faces defining a first sealing region for sealingly separating first and second fluid chambers, and said second rotating and stationary sealing faces defining a second sealing region for sealingly separating said second fluid chamber and a third fluid chamber, said second fluid chamber opening toward said outboard second ring surface of said rotating sealing ring to permit pressurized fluid in said second fluid chamber to bias said rotating sealing ring axially in said inboard direction.

22. The mechanical seal assembly according to claim 21, wherein said rotatable sealing ring is displaceable axially relative to said seal housing.

23. The mechanical seal assembly according to claim 22, wherein said seal housing includes fluid ports which supply a barrier fluid to said second seal chamber.

24. The mechanical seal assembly according to claim 23, wherein said rotating sealing ring is axially displaceable in said inboard direction when said second seal chamber is pressurized.

25. The mechanical seal assembly according to claim 21, wherein said seal housing includes a shaft bearing on an outboard end, said mounting flange of said seal housing including fasteners engagable with an equipment housing for locating said seal housing and said bearing radially relative to each other.

* * * * *